US007804456B2

(12) United States Patent
Yekeh Yazdandoost et al.

(10) Patent No.: US 7,804,456 B2
(45) Date of Patent: Sep. 28, 2010

(54) ULTRA WIDEBAND LOOP ANTENNA

(75) Inventors: Kamya Yekeh Yazdandoost, Koganei (JP); Ryuji Kohno, Koganei (JP)

(73) Assignee: National Institute of Information and Communications Technology, Tokyo (JP)

( * ) Notice: Subject to any disclaimer, the term of this patent is extended or adjusted under 35 U.S.C. 154(b) by 379 days.

(21) Appl. No.: 11/568,338

(22) PCT Filed: Dec. 28, 2004

(86) PCT No.: PCT/JP2004/019594

§ 371 (c)(1),
(2), (4) Date: Jun. 14, 2008

(87) PCT Pub. No.: WO2005/107011

PCT Pub. Date: Nov. 10, 2005

(65) Prior Publication Data

US 2008/0297424 A1 Dec. 4, 2008

(30) Foreign Application Priority Data

Apr. 28, 2004 (JP) ..... 2004-133759

(51) Int. Cl.
*H01Q 11/12* (2006.01)

(52) U.S. Cl. ..... 343/741; 343/866

(58) Field of Classification Search ..... 343/741, 343/866, 700 MS, 850
See application file for complete search history.

(56) References Cited

U.S. PATENT DOCUMENTS

| | | | | |
|---|---|---|---|---|
| 3,761,933 | A * | 9/1973 | Smalser | 343/740 |
| 4,298,878 | A | 11/1981 | Dupressoir et al. | |
| 4,940,992 | A * | 7/1990 | Nguyen et al. | 343/803 |
| 6,259,416 | B1 | 7/2001 | Qi et al. | |
| 6,693,599 | B1 * | 2/2004 | Chia et al. | 343/741 |

FOREIGN PATENT DOCUMENTS

| | | |
|---|---|---|
| JP | 2004-048233 | 2/2004 |
| JP | 2004-112044 A | 4/2004 |

OTHER PUBLICATIONS

Kin-Lu Wong et al., A Low-Profile Planar Monopole Antenna for Multiband Operation of Mobile Handsets, IEEE Transactions on Antennas and Propagation, vol. 51, No. 1, Jan. 2003, pp. 121-125.
Julien Perruisseau-Carrier et al., Dual-Polarized Broadband Dipole, IEEE Antennas and Wireless Propagation Letters, vol. 2, 2003, pp. 310-312.

(Continued)

*Primary Examiner*—Hoang V Nguyen
(74) *Attorney, Agent, or Firm*—McGlew and Tuttle, P.C.

(57) ABSTRACT

The wideband L-loop antenna is presented in this invention. It has excellent performance for lower band of UWB system and has the attractive features of small size, inexpensive, and easy to design. The antenna composed of a single metallic layer is printed on the top of a substrate and a coupled tapered transmission line is printed on the top of the same substrate. A L shape portion is formed by widening partially or wholly the width of a part of antenna elements in comparison with the other part.

13 Claims, 11 Drawing Sheets

OTHER PUBLICATIONS

R. L. Li et al., Broadband Loop Antenna for DCS-1800/IMT-2000 Mobile Phone Handsets, IEEE Microwave and Wireless Components Letters, vol. 12, No. 8, Aug. 2002, pp. 305-307.

Konstantinos D. Datsibas et al., Folded Loop Antenna for Mobile Hand-Held Units, IEEE Transactions on Antennas and Propagation, vol. 46, No. 2, Feb. 1998, pp. 260-266.

Rong-Lin Li et al., Circularly Polarized Twisted Loop Antenna, IEEE Transactions on Antennas and Propagation, vol. 50, No. 10, Oct. 2002, pp. 1377-1381.

Z. N. Chen et al., Broadband Planar Inverted-L Antennas, IEEE Microwaves, Antennas and Propagations, vol. 148, No. 5, Oct. 2001, pp. 339-342.

Zhi Ning Chen et al., Suspended Plate Antenna with a Pair of L-Shaped Strips, IEEE APS Symposium, vol. 3, Aug. 2002, pp. 64-67.

Sadahiko Yamamoto et al., Coupled Nonuniform Transmission Line and Its Applications, IEEE Transactions on Microwave Theory and Techniques, vol. MIT-15, No. 4, Apr. 1967, pp. 220-231.

O. P. Rustogi, Linearly Tapered Transmission Line and Its Application in Microwaves, IEEE Transactions on Microwave Theory and Techniques, Mar. 1969, pp. 166-168.

Noel M. Martin et al., A Tapered Transmission Line Model for the Feed-Probe of a Microstrip Patch Antenna, IEEE APS Symposium, vol. 21, pp. 154-157, May 1983.

Ian Smith, Principles of the Design of Lossless Tapered Transmission Line Transformers, 7th Pulsed Powered Conference, pp. 103-107, Jun. 1989.

Y. Wang, New Method for Tapered Transmission Line Design, Electronics Letters, vol. 27, pp. 2396-2398, Dec. 1991.

Kazuhito Murakami et al., Time-Domain Analysis for Reflection Characteristics of Tapered and Stepped Nonuniform Transmission Lines, Proceedings of IEEE International Symposium on Circuits and Systems, vol. 3, pp. 518-521, Jun. 1998.

* cited by examiner

PLAN VIEW

X-X' CROSS SECTION

Y-Y' CROSS SECTION

CURRENT DISTRIBUTION

ULTRA WIDEBAND LOOP ANTENNA

This application is a 371 of PCT/JP2004/019594 dated Dec. 28, 2004.

BACKGROUND OF THE INVENTION

1. Field of the Invention

This invention relates to a printed loop antenna with introducing a L shape portion to its arms for Ultra Wideband (UWB) signal radiation.

2. Description of the Related Art

The main difference between UWB communication system and conventional narrowband communication systems is that the UWB system transmits tremendously short pulses without any carrier and occupies bandwidth of more than a few GHz. As a result, the antenna plays an important role in the UWB systems than it in any other system.

Compare to traditional antennas it is more complicated to provide the typical parameters like bandwidth and gain within the limited antenna volume. An antenna design becomes even more critical with respect to the UWB system with high data rate and low power density. Moreover, antennas for the UWB system should have linear phase over the entire frequency, omni-directional patterns, and constant gain. Therefore, UWB antenna should be designed carefully to avoid unnecessary distortions. That's why the UWB antenna design is going to be one of the main challenges for UWB system.

Printed monopole and dipole antennas are extensively used in different wireless applications due to their many advantages, such as low profile, light weight, easy to fabricate and low cost, some of them are references [1]-[2].

The loop antennas also can be used for wireless communications (references [3]-[5]).

FIG. 11 shows a loop antenna of a prior art. On the top of a substrate 1, a single metallic layer, which is copper, is printed. However, a conventional wire loop antenna shows less than 10% bandwidth for a 2:1 VSWR. Therefore, conventional loop antenna went under different modifications to increase the bandwidth. A broadband loop antenna has been introduced by reference [3], which have a small gap in the wire loop. This small gap increased the impedance bandwidth to more than 24%.

In this invention we present a loop antenna whose left and upper arms together introduce an L-shape. However, the L-shape antenna itself is a class of broadband planar antenna, which allows the broad impedance bandwidth and less cross-polarization radiation (references [6], [7]).

REFERENCES

[1] K. L. Wong, G. Y. Lee, T. W. Chiou, "A low-profile planar monopole antenna for multiband operation of mobile handsets," IEEE Transactions on Antennas and Propagation, vol. 51, pp. 121-125, January 2003.

[2] J. Perruisseau-Carrier, T. W. Hee, P. S. Hall, "Dual-polarized broadband dipole," IEEE Antennas and Wireless Propagation Letters., Vol. 2, pp. 310-312, 2003.

[3] R. L. Li, E. M. Tentzeris, J. Laskar, V. F. Fusco, and R. Cahill, "Broadband Loop Antenna for DCS-1800/IMT-2000 Mobile Phone Handsets," IEEE Microwave and Wireless Components Letters, vol. 12, pp. 305-707, August 2002.

[4] K. D. Katsibas, C. A. Balanis, P. A. Tirkas, and C. R. Birtcher, "Folded Loop Antenna for Mobile Hand-Held Units," IEEE Transaction on Antennas and Propagation, vol. 46, pp. 260-266, February 1998.

[5] R. L. Li, V. F. Fusco, "Circularly Polarized Twisted Loop Antenna," IEEE Transaction on Antennas and Propagation, vol. 50, pp. 1377-1381, October 2002.

[6] Z. N. Chen and M. Y. W. Chia, "Broadband planar inverted-L antennas," Microwaves, Antennas and Propagation, IEE Proceedings, vol. 148, pp. 339-342, October 2001.

[7] Z. N. Chen, M. Y. W. Chia, "Suspended plate antenna with a pair of L-shaped strips," IEEE APS Symposium, vol. 3, pp. 64-67, June 2002.

[8] S. Yamamoto, T. Azakami, and K. Itakura, "Coupled non-uniform transmission line and its applications," IEEE Transactions on Microwave Theory and Techniques, vol. 15, pp. 220-231, April 1967.

[9]. P. Rustogi, "Linearly Tapered Transmission Line and Its Application in Microwaves," IEEE Transactions on Microwave Theory and Techniques, vol. 17, pp. 166-168, March 1969.

[10] N. M. Martin and D. W. Griffin, "A tapered transmission line model for the feed-probe of a microstrip patch antenna," IEEE APS Symposium, vol. 21, pp. 154-157, May 1983.

[11] I. Smith, "Principles of the design of lossless tapered transmission line transformers," $7^{th}$ Pulsed Power Conference, pp. 103-107, June 1989.

[12] Y. Wang, "New method for tapered transmission line design," Electronics Letters, vol. 27, pp. 2396-2398, December 1991.

[13] K. Murakami and J. Ishii, "Time-domain analysis for reflection characteristics of tapered and stepped nonuniform transmission lines," Proceedings of IEEE International Symposium on Circuits and Systems, vol. 3, pp. 518-521, June 1998.

SUMMARY OF THE INVENTION

1. Object of the Invention

There are antennas with good impulsive behavior at the cost of poor matching and large reflections. Also there are antennas with resistive loading, which give lower radiation efficiency, but a good matching and high impedance bandwidth.

The large size parabolic antennas with good performance can be used for UWB system, however, make them less suitable for most commercial (with respect to price) and hand-held or portable (with respect to size) applications.

The antenna design for Ultra Wideband (UWB) signal radiation is one of the main challenges of the UWB system, especially when low-cost, geometrically small and radio efficient structures are required for typical applications.

In this invention, we propose a novel Loop antenna with very compact size that could be use as an on-chip or stand-alone antenna for UWB system.

2. Means for Achieving the Object

This invention presents a novel printed loop antenna with introducing a L shape portion to its arms. The antenna offers excellent performance for lower-band frequency of UWB system, ranging from 3.1 (GHz) to 5.1 (GHz). The antenna exhibits a −10 (dB) return loss over the entire bandwidth.

The antenna is designed on FR4 substrate and fed with 50 ohms coupled tapered transmission line. It is found that the lower frequency band depends on the L portion of the loop antenna, however the upper frequency limit was decided by the taper transmission line. The proposed antenna is very easy to design and inexpensive.

3. Advantages of the Invention

The wideband L-loop antenna is presented in this invention. It has excellent performance for lower band of UWB system and has the attractive features of small size, inexpensive, and easy to design. A VSWR≦1.6 was shown to be achievable over the entire bandwidth, 3.1-5.1 (GHz). The return loss of −10 dB is achieved over the frequency band. The gain in the whole range of frequency band is more than 1 dBi. Two analysis techniques, Moment Method and Finite Element Method, are applied to design this novel antenna, which could be concluded that, the results are trustable. A good impedance matching has been achieved in the simplest way.

DETAILED DESCRIPTION OF THE PREFERRED EMBODIMENTS

Figure 1A:
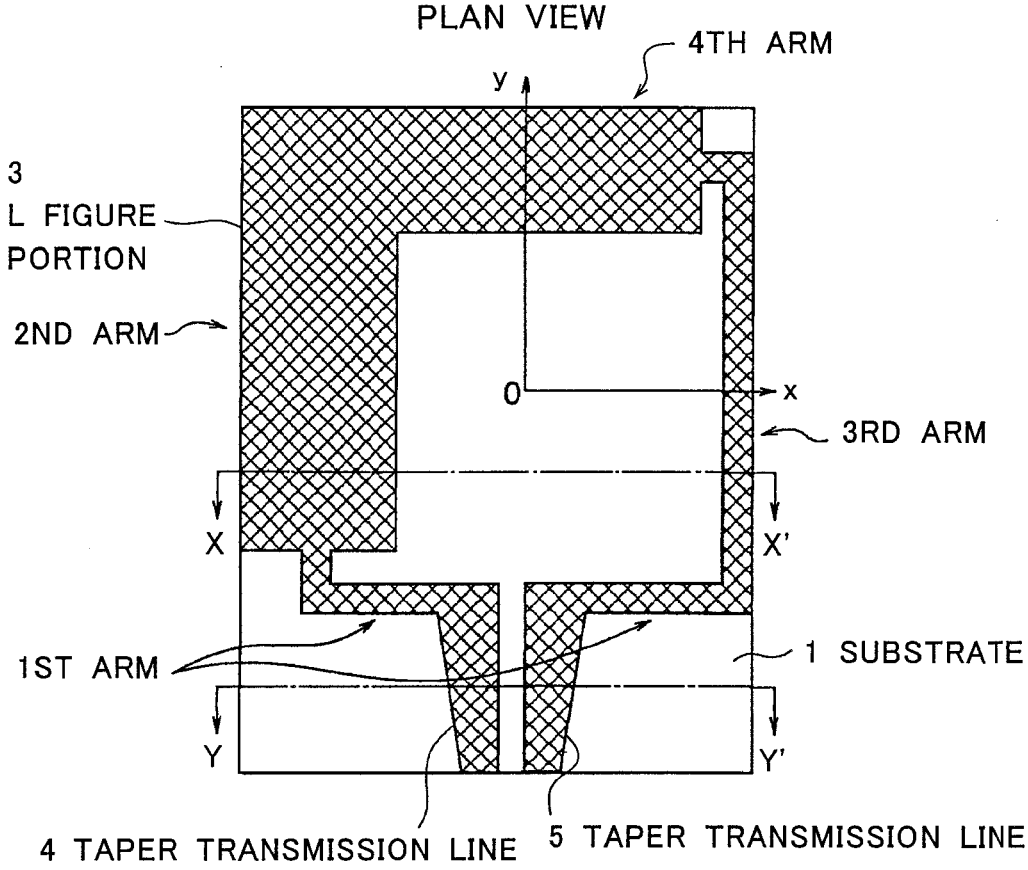
FIG. 1 shows a plane view and cross-sectional views of the L-loop antenna of an embodiment of the present invention.
Figure 1B:
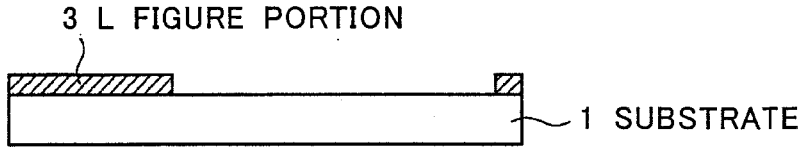
Figure 1C:
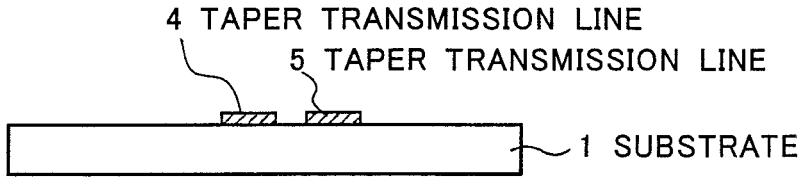
Figure 2:
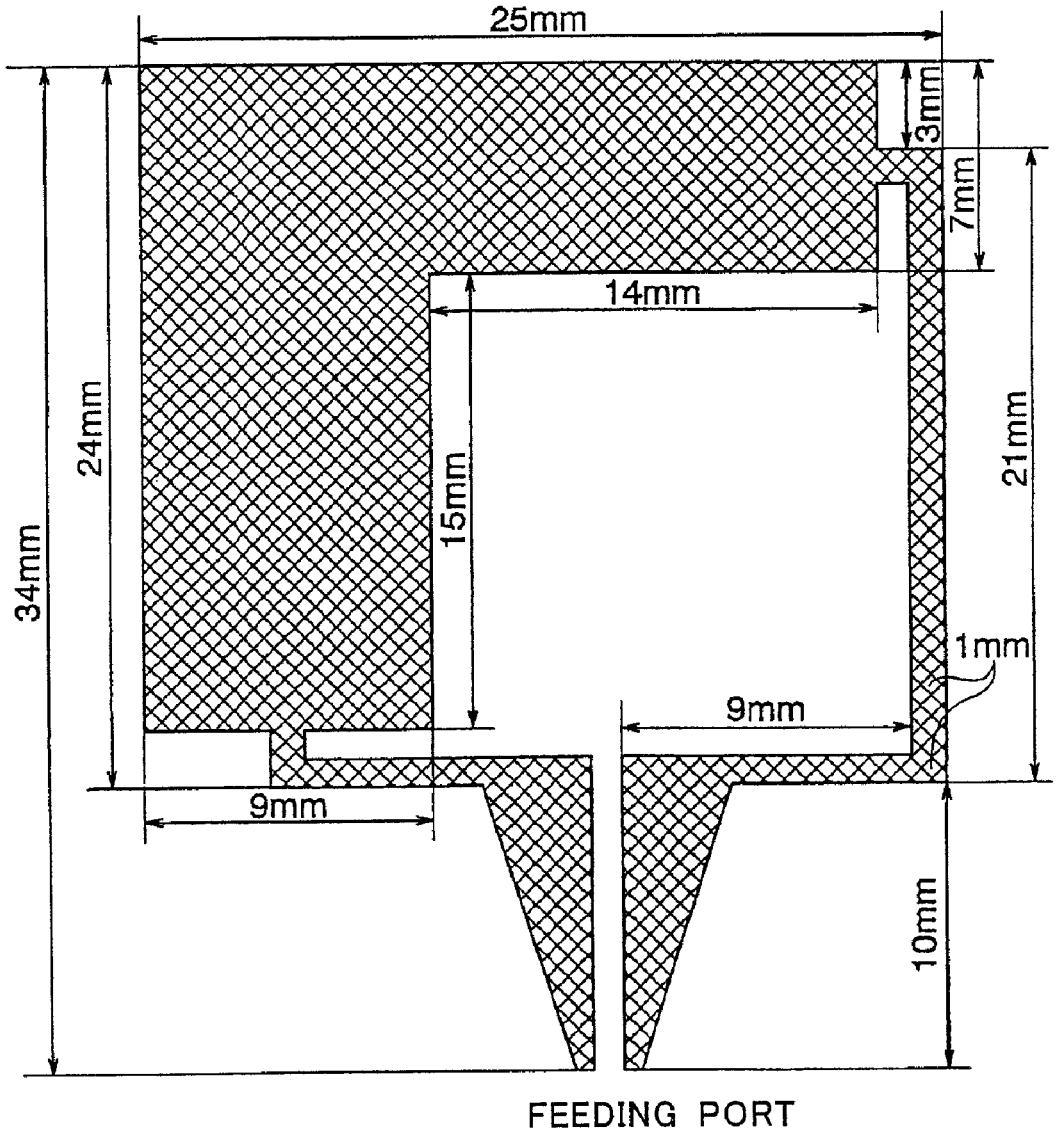
FIG. 2 shows an example of the L-loop antenna of the present invention.

FIG. 1 and FIG. 2 show the novel low profile planar L-loop antenna. FIG. 1 shows an embodiment of the present invention. FIG. 1A is a plane view of the L-loop antenna, FIG. 1B is a cross-sectional view at X-X', and FIG. 1C is a cross-sectional view at Y-Y'. FIG. 2 shows an example of the L-loop antenna as shown in FIG. 1. In FIG. 1 a substrate 1 is made of insulation material such as FR-4, Teflon (Registered Trademark), or silicon, and on the substrate 1, a L-loop antenna is made of metal such as copper, silver, platinum, gold or aluminum.

In FIG. 1, a novel printed loop antenna with introducing a L shape portion- to its arms is shown. The antenna is formed into a square or rectangular loop configuration having four arms. A first arm is cut off at the center and the both cut ends are connected respectively to a couple of tapered transmission lines 4,5. Second and third side arms are connected respectively with the outer ends of the first arm. Each of the other ends of the second and third arms are connected to both ends of a fourth arm opposing to the first arm thereby to form a square or rectangular loop.

The L shape portion is formed by widening the width of one of the side arms and the fourth arm in comparison with the other side arm and the first arm which is connected with the coupled tapered transmission line 4,5. However, it is not necessarily required that the width over the whole length of the one side arm and the fourth arm is widened. The width may be widened over the partial length of each of the one side arm and the fourth arm.

To have a linearly polarized radiation the total length of outer limits of the square (or rectangular) loop antenna should be in substantially one wavelength. Designing an antenna for 3.1 GHz will give the wavelength of $\lambda_0$=96.77 mm. The proposed antenna is composed of a single metallic layer, which is copper, with thickness of $h_m$, and printed on the top of a substrate 1 of thickness $h_s$ and relative permittivity $\epsilon_r$. A coupled tapered transmission line 4,5 is printed on the top of same substrate 1.

The metallic layer has thickness of $h_m$=0.018 mm. The patch is on a substrate with $\epsilon_r$=4.4, loss tangent of tan θ=0.02, and thickness of $h_s$=1 mm. The size of the proposed antenna is 24×25×1 mm, which is quite appropriate for wireless system. The square loop has 98 mm length, which is fairly close to one wavelength of antenna design. The reference plane is at the center of antenna.

The transmission lines 4 and 5 are connected to an external circuit device (not shown). The transmission lines shown in FIG. 1 is a linear taper type of which outer side configuration is linear. The tapered transmission lines are gradually widened from its connected portion to the antenna elements, and is formed one body with the antenna elements on the substrate.

The tapered transmission lines have shown good impedance matching over a wide frequency range (references [8]-[13]). The antenna is fed from a 50 Ohms coaxial cable through a coupled tapered transmission line. The geometry of the taper is chosen to minimize the reflection and optimize impedance matching and bandwidth.

The proposed antenna can be made from a plate composed of a substrate of FR 4 and a copper plate stick on the substrate. The antenna patterns composed of the antenna elements and the impedance matching portions are made by photo-etching the copper plate, for example. A layer of photo-resist film is formed on the copper plate by painting photo-resist. Next the painted photo-resist layer is exposed through a photo-mask, which has the pattern of the antenna elements and the impedance matching portion. The photo-resist film is soaked in solution to dissolve the not lighted portion. The lighted portion of the photo-resist layer is left on the copper plate. The left portion of the exposed photo-resist layer on the copper is used as an etching musk. Further the whole is soaked in etching liquid and etches the copper plate with the etching musk of photo-resist. Thus the L-loop antenna to which the taper transmission line 4 and 5 are united is formed on the substrate.

FIG. 2 shows an example of detail size of the L-loop antenna.

Figure 3A:
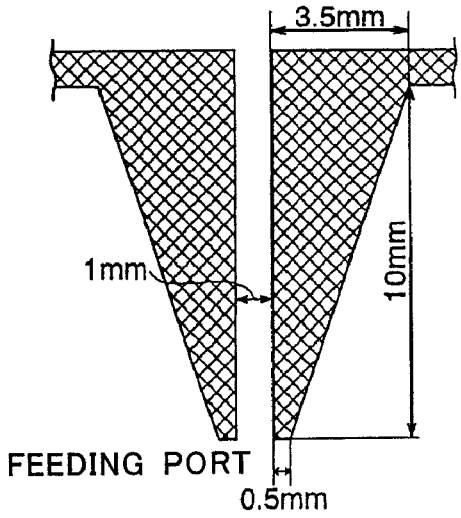
FIG. 3 shows an example of taper transmission line applying to the L-loop antenna of the present invention.
Figure 3B:
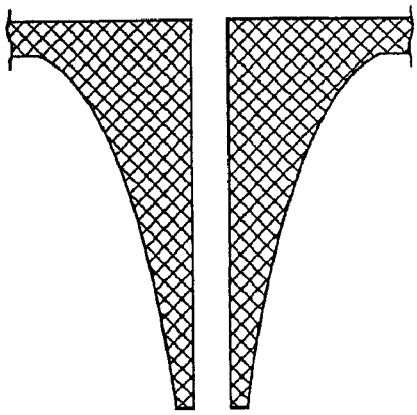
Figure 3C:
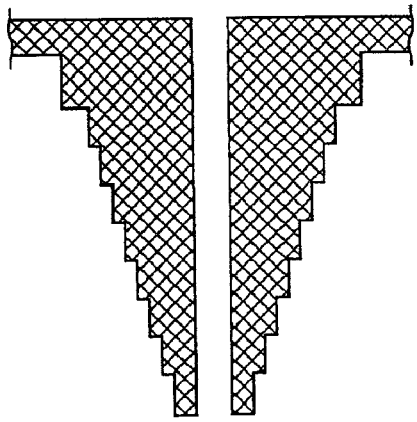

FIG. 3A-3C shows some examples of taper transmission lines of the present invention. FIG. 3A is a taper line type transmission line. FIG. 3B is a curved type transmission line of which outer side configuration is curved. FIG. 3C shows a step type transmission line.

FIG. 4-FIG. 10 show various characteristics of the embodiment. The characteristics are obtained from the L-loop antenna having transmission lines of the size of FIG. 2 and FIG. 3A.

The designed antenna can operate in the frequency range of 3.1-5.1 GHz. The proposed design is described in detail, and simulation results of the antenna are presented. The simulation results have been obtained from two different softwares, Ansoft Designer® 1.1 and Ansoft High Frequency Structure Simulator, HFSS® 9.1, to make sure that the obtained results are trustable.

Figure 4:
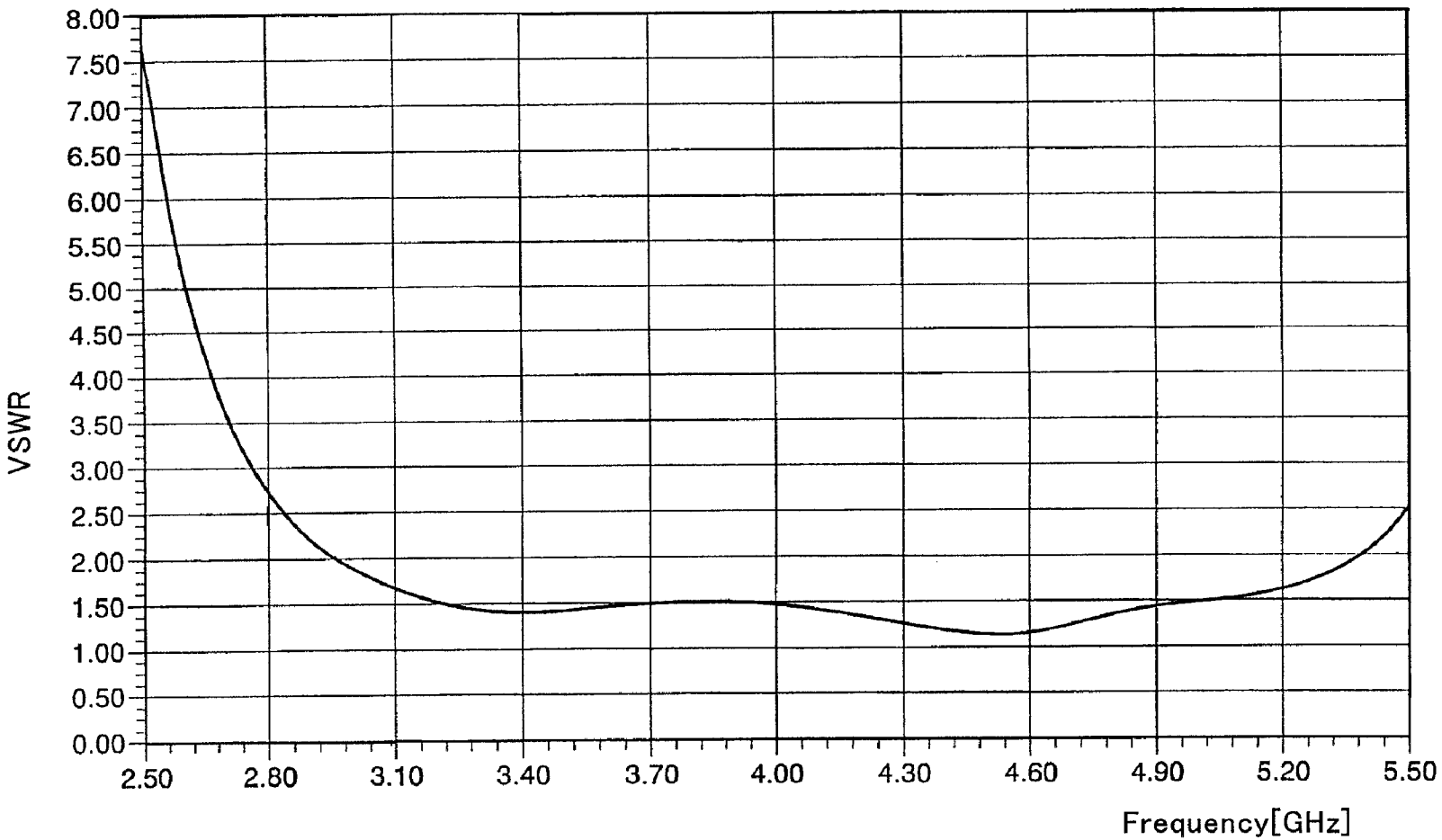
FIG. 4 shows frequency characteristic of VSWR of the L-loop antenna of the present invention.

FIG. 4 shows frequency characteristic of VSWR (Voltage Standing Wave Ratio) of the antenna. FIG. 4 is showing that, the designed antenna has VSWR≧1.6 from frequency of 3.1 to 5.1 GHz.

Figure 5:
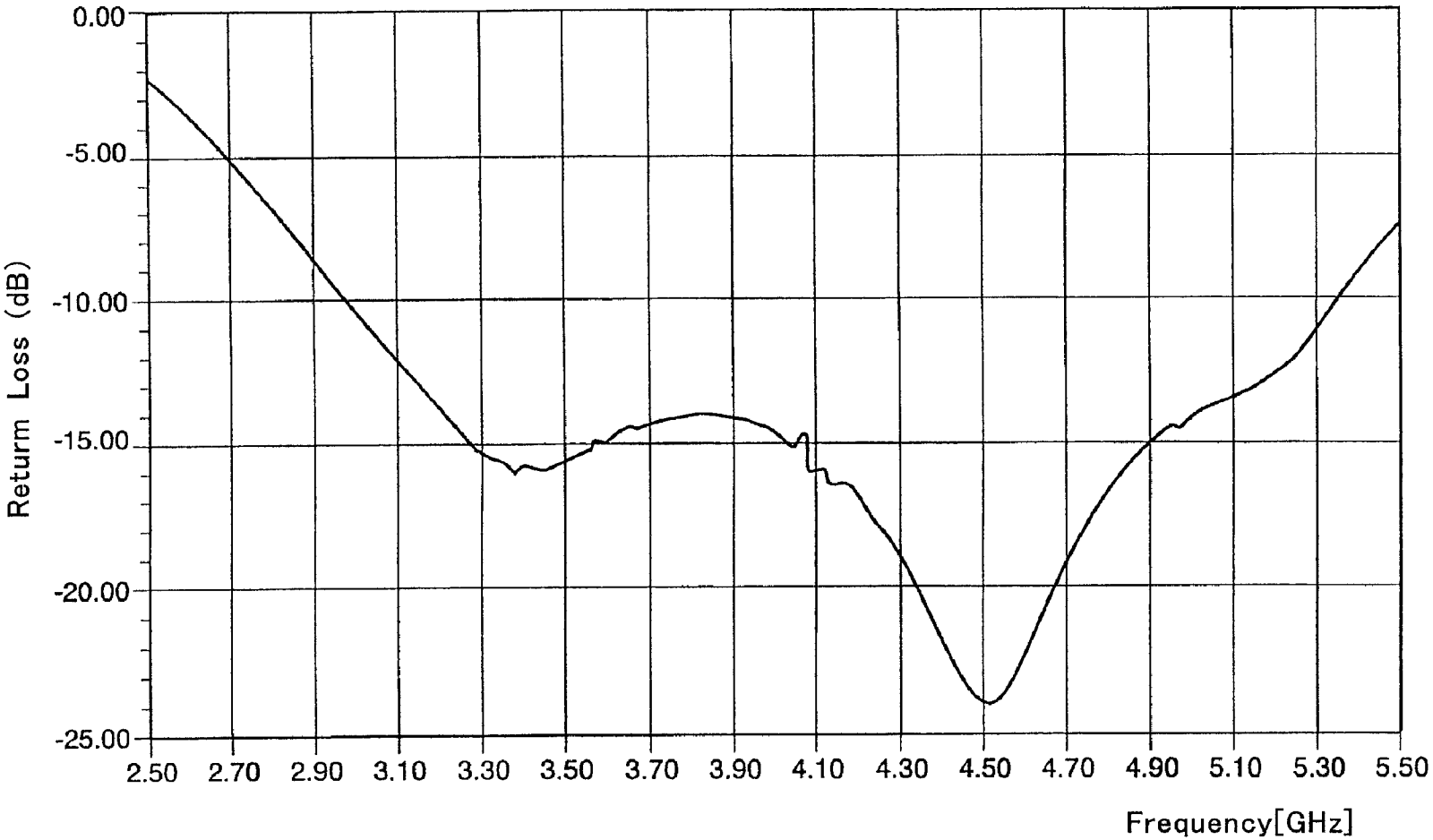
FIG. 5 shows frequency characteristic of return loss of the L-loop dipole antenna of the present invention.

FIG. 5 shows the return loss of invented antenna. The return loss is less than −10 dB in the entire frequency range. It is clearly seen that a wide operating bandwidth is obtained.

Figure 6:
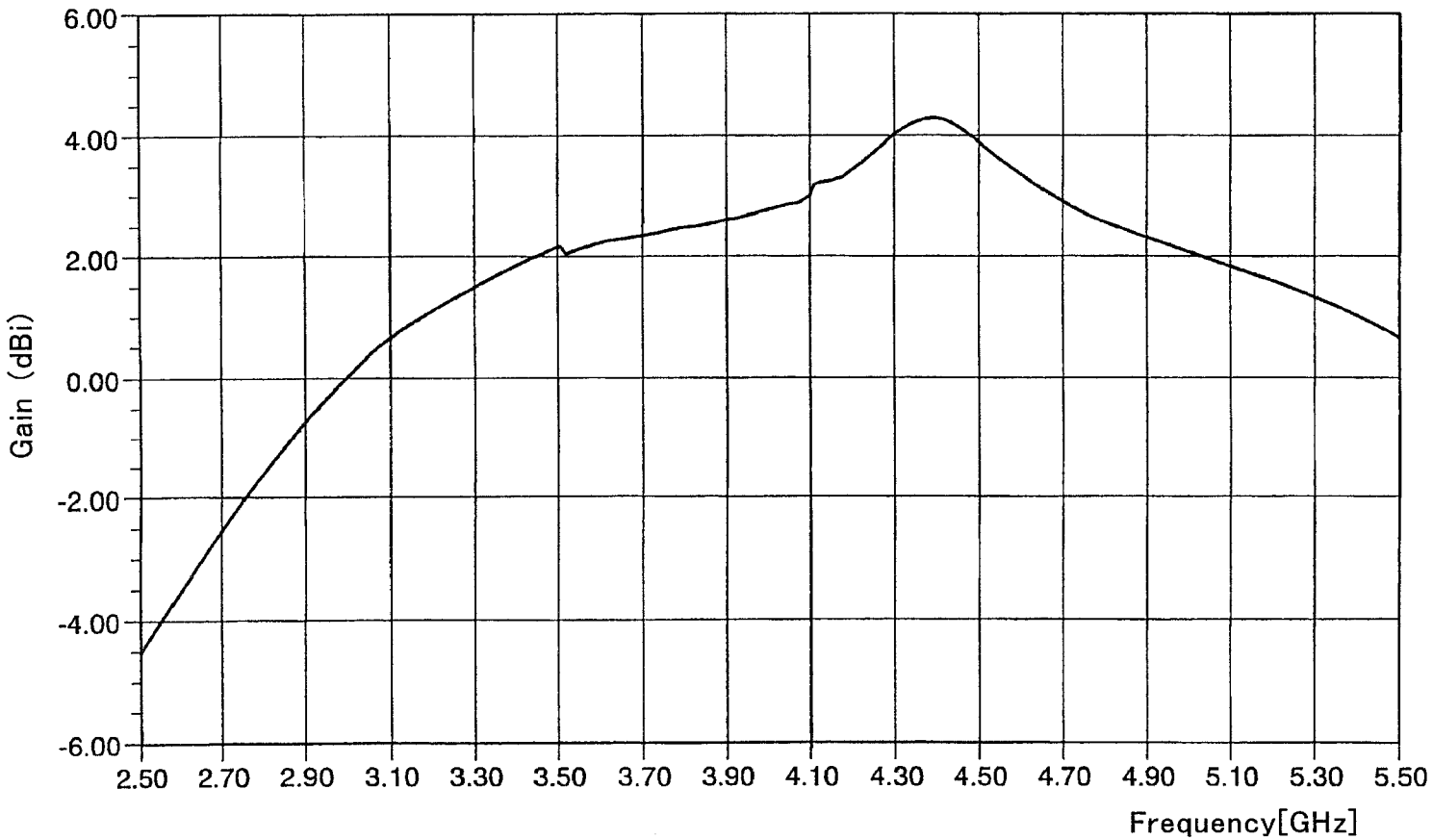
FIG. 6 shows frequency characteristic of gain of the L-loop antenna of the present invention.

FIG. 6 shows the frequency characteristic of antenna gain of the antenna of the present invention. As shown in the Figure, the designed antenna is achieved more than 1 dBi gain in the entire frequency.

Figure 7:
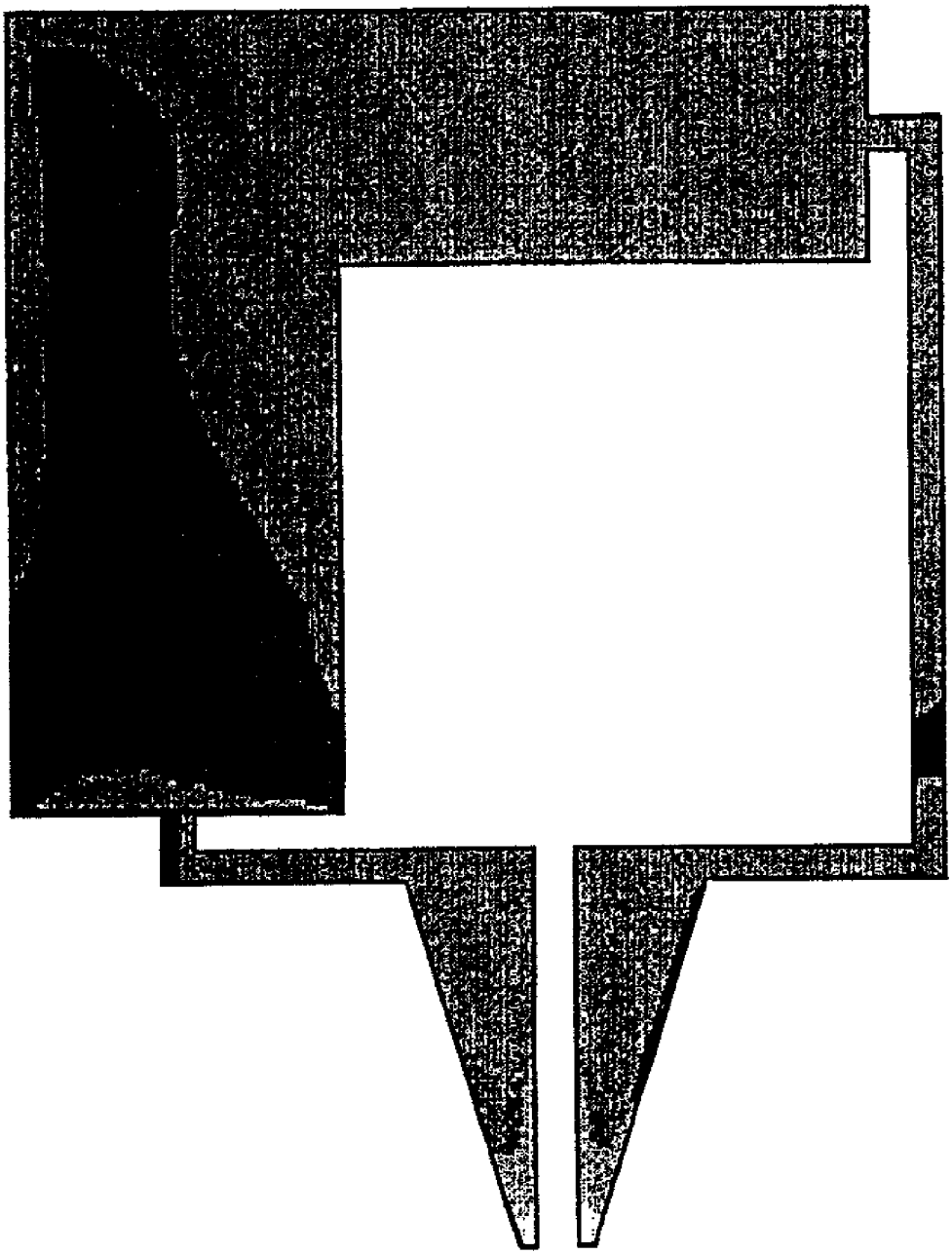
FIG. 7 shows current distribution of the L-loop antenna of the present invention.

FIG. 7 shows current distribution of the L-loop antenna of the present invention. In the figure, the lighter the portion is, the stronger the current.

Figure 8:
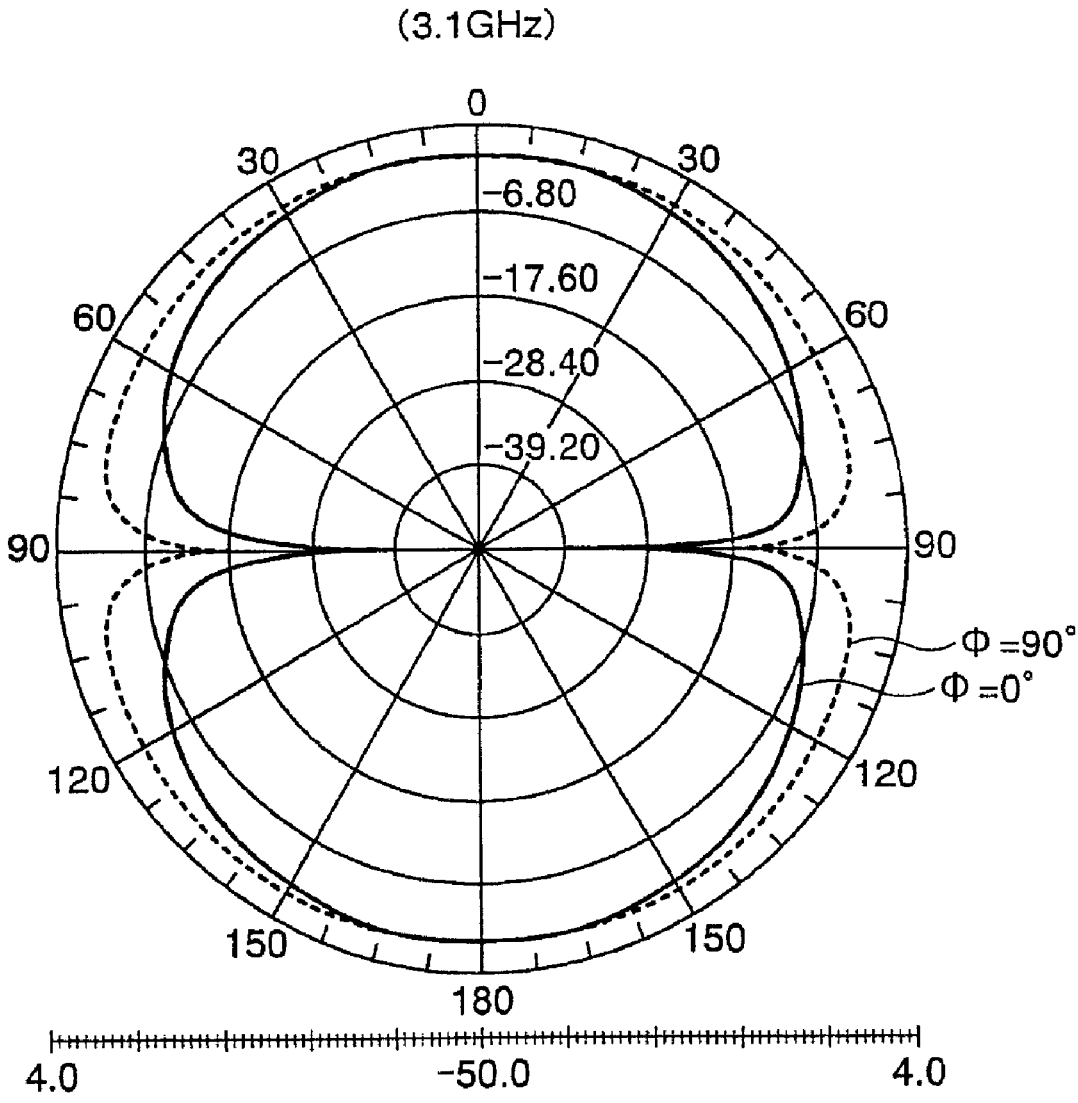
FIG. 8 shows radiation pattern at 3.1 GHz of the L-loop antenna of the present invention.
Figure 9:
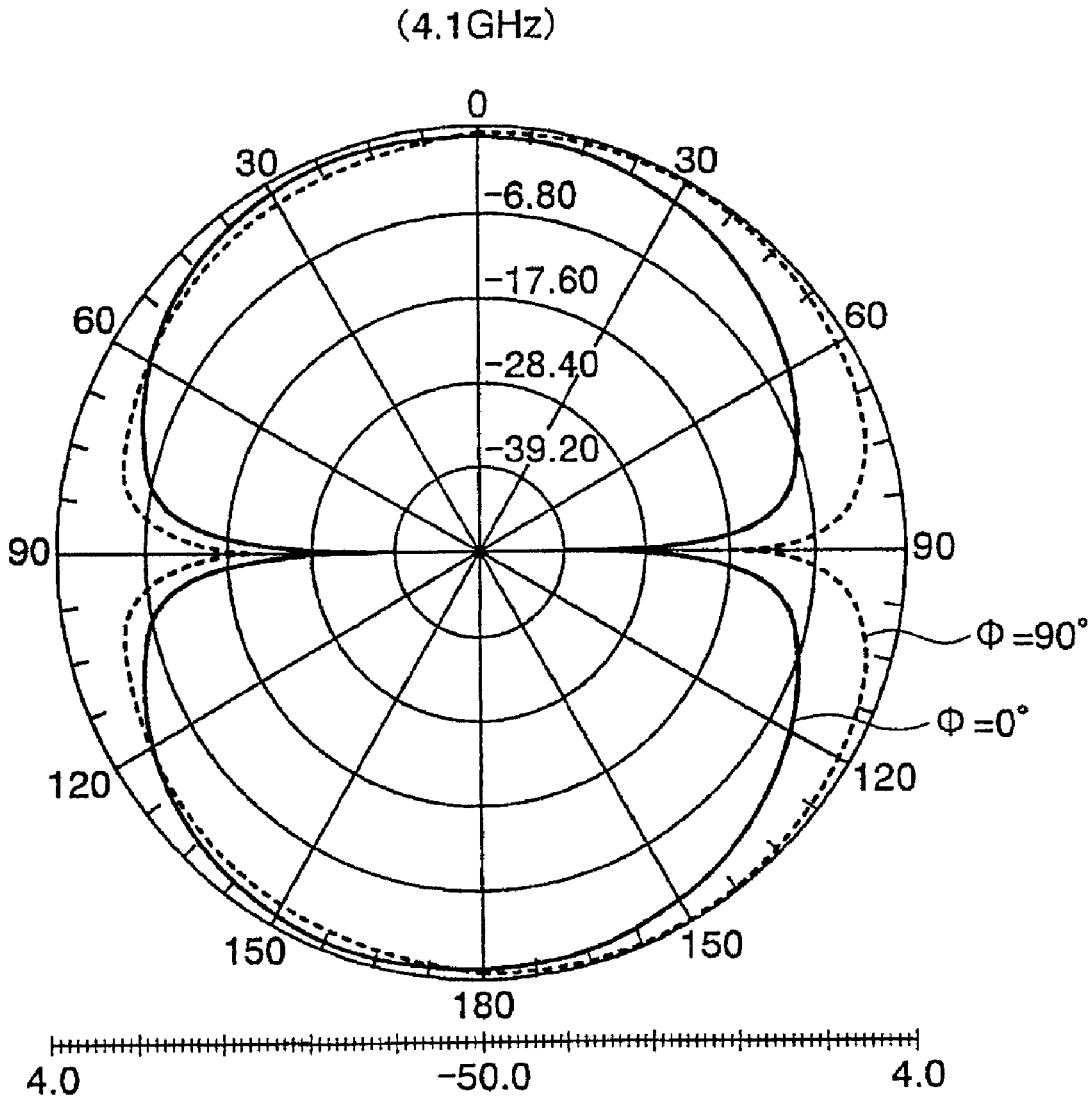
FIG. 9 shows radiation pattern at 4.1 GHz of the L-loop antenna of the present invention.
Figure 10:
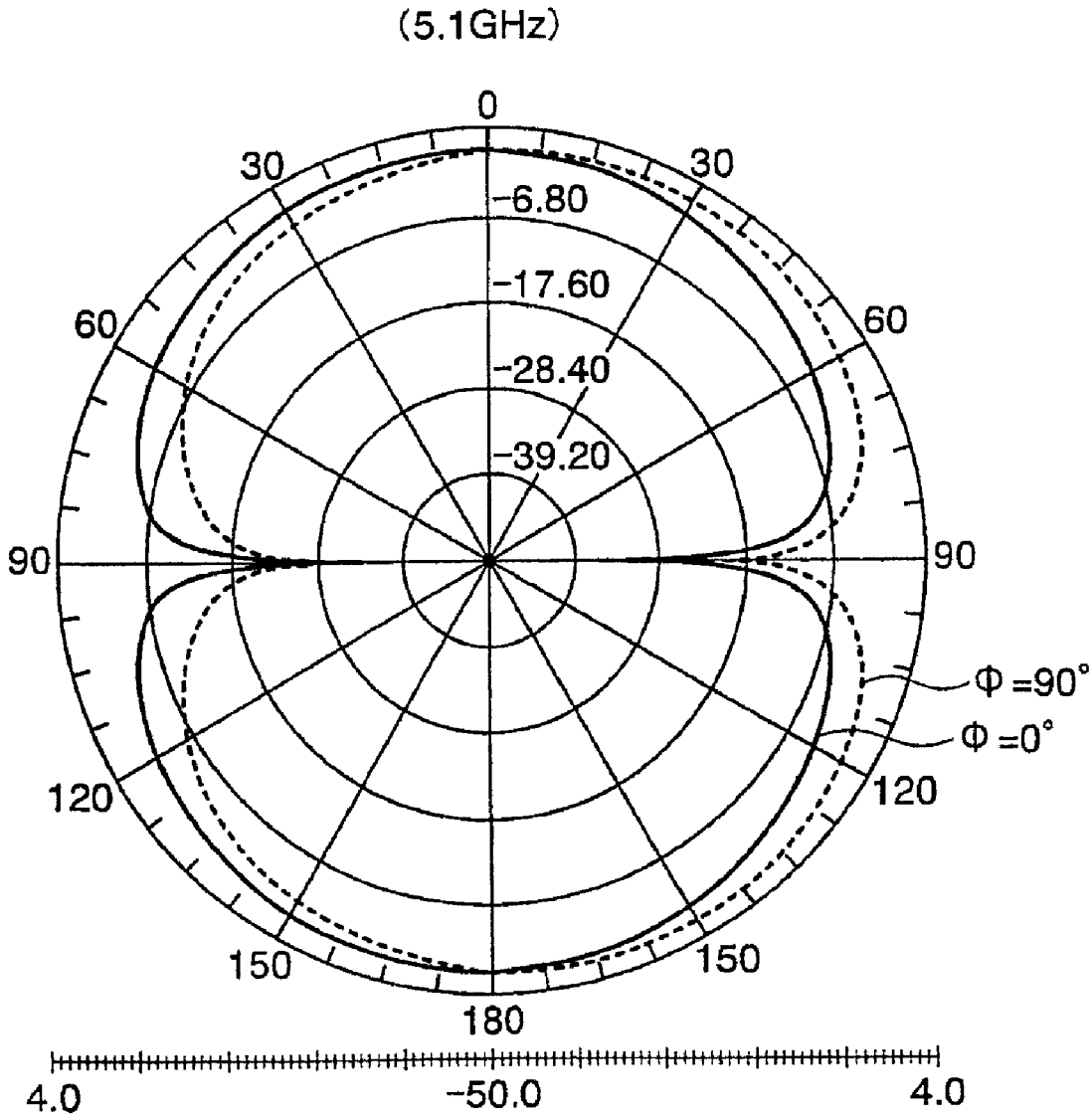
FIG. 10 shows radiation pattern at 5.1 GHz of the L-loop antenna of the present invention.
Figure 11:
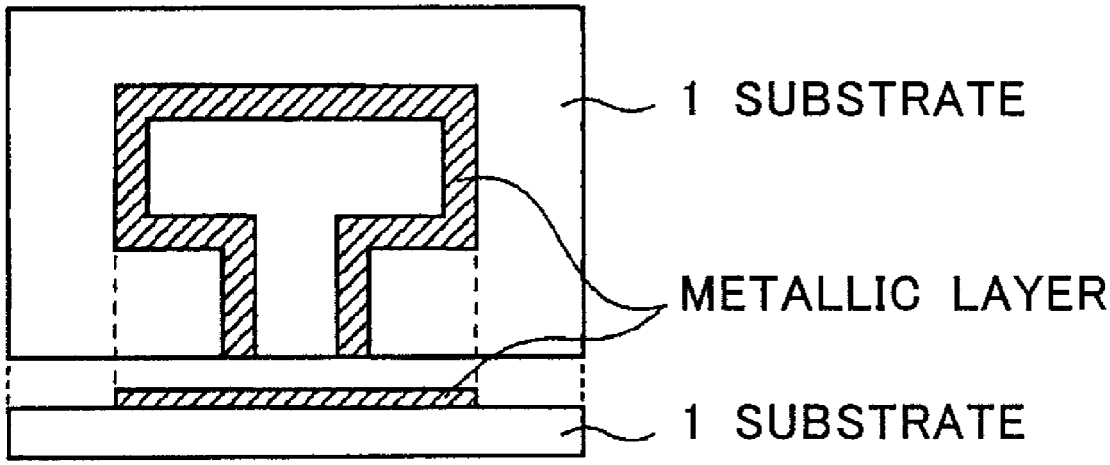
FIG. 11 PRIOR ART
FIG. 11 shows a loop antenna of the a prior art.

FIG. 8-10 plots the radiation pattern at 3.1, 4.1, and 5.1 GHz. The x-y coordinates are defined as shown in FIG. 1 that the origin is set at the center of the antenna plane and x-axis and y-axis are defined. The z axis is defined as perpendicular to the antenna plain and passing through the origin on the antenna plane.

In FIG. 8-FIG. 10, the pattern of real line is the radiation pattern of $\phi=0$ degree, and the dotted line is $\phi=90$ degree. The characteristics shows the antenna of the present invention has good radiation patterns. It can be seen that, the radiation pattern almost remain same for all the frequency, which is very important for the wireless system with high data rate.

What is claimed is:

1. An ultra wideband loop antenna for use in the lower band of an UWB system comprising an antenna element having a linear first arm having opposite ends and which is cut off at the center to have two cut ends which are connected respectively to a couple of transmission lines, linear second and third side arms each having opposite ends, one of which being connected respectively with the opposite ends of the first arm, and a linear fourth arm which is connected with each of the other of the opposite ends of the second and third arms thereby to form a planar square or rectangular loop, wherein, the antenna composed of a single metallic layer is printed on the top of a substrate and the coupled tapered transmission line is printed on the top of the same substrate, wherein the transmission lines are tapered, and wherein a L shape portion is formed by widening partially or wholly the width of one of the side arms and the fourth arm in comparison with the other side arm and the first arm.

2. An ultra wideband loop antenna according to claim 1, wherein the tapered transmission lines are gradually widened to the antenna elements from the ends to which an external device can be connected, and is formed one body with the antenna elements on the substrate.

3. An ultra wideband loop antenna according to claim 2, wherein outer sides of the tapered transmission lines have a linear, curved, or step configuration.

4. An ultra wideband loop antenna according to claim 1, wherein the metal layer is composed of one of copper, silver, platinum, gold or aluminum.

5. An ultra wideband loop antenna according to claim 1, wherein the substrate is composed of one of Teflon (Registered Trademark), FR-4, or silicon.

6. An ultra wideband loop antenna in accordance with claim 1, wherein:

said linear second arm is arranged substantially perpendicular to said linear first arm;

said linear third arm is arranged substantially perpendicular to said linear first arm;

said linear fourth arm is arranged substantially perpendicular to said linear first arm and said linear second arm.

7. An ultra wideband loop antenna comprising:

a pair of tapered transmission lines;

a first linear arm having two parts arranged linearly and spaced apart from each other to define a cutout section, each of said two parts having cut ends adjacent said cutout section, said cut ends being connected to said pair of tapered transmission lines, said linear first arm having opposite ends on diametrically opposite ends of said linear first arm;

a linear second arm directly extending from one of said opposite ends of said first linear arm;

a linear third arm directly extending from another one of said opposite ends of said first linear arm;

a linear fourth arm directly connected to ends of said second and third arms which are diametrically opposite said linear first arm;

said first, second, third and fourth arms being arranged to form a planar square or rectangular loop;

a width of said linear second arm and said linear fourth arm being wider than a width of said linear first time and said linear third arm to have said linear second arm and said linear fourth arm form an L shaped portion.

8. An ultra wideband loop antenna in accordance with claim 7, wherein:

said linear second arm is arranged substantially perpendicular to said linear first arm;

said linear third arm is arranged substantially perpendicular to said linear first arm;

said linear fourth arm is arranged substantially perpendicular to said linear first arm and said linear second arm.

9. An ultra wideband loop antenna in accordance with claim 8, wherein:

said tapered transmission lines are gradually widened from ends of said transmission lines to which an external device can be connected, to said linear first arm, said tapered transmission lines being formed in one body with said arms;

said tapered transmission lines are arranged substantially perpendicular to said linear first arm.

10. An ultra wideband loop antenna in accordance with claim 8, wherein:

said tapered transmission lines are gradually widened from ends of said transmission lines to which an external device can be connected, to said linear first arm, said tapered transmission lines being formed in one body with said arms;

said tapered transmission lines are arranged substantially perpendicular to said linear first arm;

said arms are formed from an electrically conductive material;

a non-conductive substrate is provided, said arms and said transmission lines being arranged on one side of said substrate.

11. An ultra wideband loop antenna in accordance with claim 7, wherein:

said tapered transmission lines are gradually widened from ends of said transmission lines to which an external device can be connected, to said linear first arm, said tapered transmission lines being formed in one body with said arms.

12. An ultra wideband loop antenna in accordance with claim 7, further comprising:

anon-conductive substrate, said arms and said transmission lines being arranged on one side of said substrate.

13. An ultra wideband loop antenna in accordance with claim 7, wherein:

said arms are formed from an electrically conductive material.

* * * * *